US006527445B2

(12) United States Patent
LaFleur et al.

(10) Patent No.: US 6,527,445 B2
(45) Date of Patent: Mar. 4, 2003

(54) LINERS OR BAGS AND METHOD OF MAKING THEM

(75) Inventors: Lee LaFleur, Manistee, MI (US); R. Daniel Brumm, Manistee, MI (US); Aaron W. Bryan, Custer, MI (US); James E. Rozmarek, Manistee, MI (US); Jeffrey D. Wright, Manistee, MI (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 09/847,729

(22) Filed: May 2, 2001

(65) Prior Publication Data

US 2002/0164089 A1 Nov. 7, 2002

(51) Int. Cl.[7] ..... B65D 30/00

(52) U.S. Cl. ..... 383/37; 383/120; 493/210; 493/244

(58) Field of Search ..... 383/120, 37, 104, 383/121; 493/210, 244

(56) References Cited

U.S. PATENT DOCUMENTS

| | | | | | |
|---|---|---|---|---|---|
| 4,524,459 A | * | 6/1985 | Titchenal | ..... | 383/122 |
| 4,561,107 A | * | 12/1985 | Herder | ..... | 383/122 |
| 4,685,148 A | * | 8/1987 | Titchenal | ..... | 383/100 |
| 5,100,000 A | * | 3/1992 | Huseman | ..... | 206/554 |
| 5,104,236 A | | 4/1992 | LaFleur | | |
| 5,918,984 A | * | 7/1999 | LaFleur et al. | ..... | 206/554 |
| 6,371,646 B1 | * | 4/2002 | LaFleur | ..... | 383/109 |

FOREIGN PATENT DOCUMENTS

| | | | | | |
|---|---|---|---|---|---|
| FR | 002672033 A1 | * | 7/1992 | ..... | 383/120 |
| NL | 7611389 | * | 4/1978 | ..... | 383/120 |
| WO | WO 9008071 | * | 7/1990 | ..... | 383/37 |

* cited by examiner

*Primary Examiner*—Jes F. Pascua
(74) *Attorney, Agent, or Firm*—Michael Best & Friedrich, LLC

(57) ABSTRACT

A method of forming a plurality of interconnected bulk bags or with an interconnecting section of material between adjacent bags on a roll or blank of flexible material to permit the blank of material to be advanced for subsequent processing. The interconnecting section is defined at least in part by a separation line that permits scrap or waste material to be removed from the blank without removing the interconnecting section. This permits the bags to remain interconnected after they are formed so that they may be disposed on a roll or folded in a box for convenient shipping and handling of a plurality of bags. Desirably, perforations maybe provided between adjacent bags to facilitate removal of an individual bag from the remainder.

24 Claims, 3 Drawing Sheets

LINERS OR BAGS AND METHOD OF MAKING THEM

FIELD OF THE INVENTION

This invention relates generally to containers and more particularly to bags or liners formed of flexible material.

BACKGROUND OF THE INVENTION

Many granular and liquid products have been shipped and stored in large bulk bags or bulk containers with liners, which may contain as much as a ton or more of material. Some of these bulk bags are flexible, contain a liner, and when empty can be folded to a generally flat condition. One such flexible bag and liner is disclosed and claimed in U.S. Pat. No. 5,104,236. These flexible bags and liners for bulk containers, have been formed from a single tubular blank of material to form generally rectangular ends interconnected by generally rectangular side walls. When filled, these bags can be stacked one on top of another. For some applications, the bags may be made of a woven fabric and for other applications, a plastic film or sheet material. For some applications, particularly for storing liquids, a bag or liner of a liquid impervious film material is received in and reinforced and protected by bag of a woven fabric. Usually these bags have a spout in one or both ends for filling and emptying the bags.

Some such flexible bulk bags are formed by folding one or more blanks of flexible material to provide a pair of gusset panels folded inwardly and disposed between a pair of overlying flat panels. Heat seals or stitching along inclined lines forming triangular portions at one or both ends of the bag provide integral, rectilinear end walls of the bag interconnected by four sidewalls. Some bags include a spout extending from their upper end wall to facilitate filling and emptying the bag and have a completely closed bottom wall forming a so-called "V-bottom" bag wherein the bottom of the bag is generally V-shaped when the bag is gusseted and folded flat.

Desirably, the blanks of flexible material used to form the bulk bags may be provided in elongate rolls to facilitate manufacture of a plurality of bags. With bags having a spout at one end and a closed V-shaped opposite end it is preferable to form a plurality of bags on the rolls of material with the V-shaped wall of each bag adjacent to a V-shaped wall of an adjacent bag. So arranged the spout of each bag is connected to or adjacent to a spout of another adjacent bag on the roll of material. Bags can also be arranged with the V-shaped wall adjacent to the spout of the adjacent bag. After heat sealing adjacent V-shaped end walls, or adjacent V-shaped walls and spout, and removing the waste or scrap material between the adjacent bags, there is no material left between adjacent bags on the roll of material due at least in part to the heat seals leading to the apex of the V-shaped wall, separating the blank between the bags. This prevents subsequent processing equipment from pulling or advancing the roll of material for subsequent processing. Accordingly, bags of this type had to be separated from the roll of material along a straight line perpendicular to side edges of the blank to provide smaller, individual rectangular blanks that are individually processed to form at least the V-shaped wall of each bag. This increases the time, labor and cost to make the bags, reduces the ability to automate the manufacturing process and greatly reduces the efficiency of the manufacturing process.

SUMMARY OF THE INVENTION

A method of forming a plurality of interconnected bulk bags or liners with an interconnecting section of material between adjacent bags on a roll or blank of flexible material to permit the blank of material to be advanced for subsequent processing. The interconnecting section is defined at least in part by a separation line that permits scrap or waste material to be removed from the blank without removing the interconnecting section. This permits the bags to remain interconnected after they are formed so that they may be disposed on a roll or folded in a box for convenient shipping and handling of a plurality of bags. Desirably, perforations maybe provided between adjacent bags to facilitate removal of an individual bag from the remainder.

Preferably, closed ends of the bags are formed by heat sealing a gusseted blank of material along inclined lines forming so-called V-shaped end walls when the bags are folded flat. Waste or scrap material between the heat seal lines of adjacent V-shaped end walls of two adjacent bags on the blank may be removed without removing the interconnecting material between adjacent closed ends of the adjacent bags. To accomplish this, tear lines extend to the heat seal lines, which form the closed end of each bag to separate the waste material from the interconnecting section of material between the bags. Accordingly, when the waste material is removed by tearing or peeling along and outboard of the heat seal line of the closed end of the bag, such tear continues until it reaches and follows along the tear line to prevent removal of the interconnecting section between adjacent bags. Desirably, serration's are provided in the interconnecting section between the adjacent bags to facilitate subsequent removal of the interconnecting section prior to use of the bags.

Objects, features and advantages of this invention include enabling substantially automated manufacture of a plurality of bags with a V-shaped end wall from one or more rolls or blanks of flexible material, permitting a plurality of bags to remain interconnected after forming so that they may be further processed, allowing a plurality of bags with a V-shaped end wall to be rolled up or otherwise manipulated for convenient shipping and handling prior to their use, facilitates manufacture of adjacent bags having adjacent V-shaped end walls and bags having a V-shaped end wall disposed adjacent to a spout of an adjoining bag, reduces the time, labor and cost to form a plurality of bulk bags, can be readily implemented with substantially conventional bag manufacturing machines, eliminates the need to separate individual bags from the blank to form closed ends of the bags, increases the efficiency of the bag forming machinery and process and is of relatively simple design.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 2:
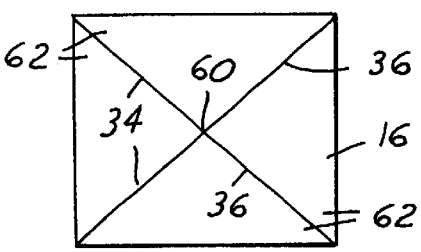
FIG. 2 is an end view of the bottom wall of the bag.
Figure 1:
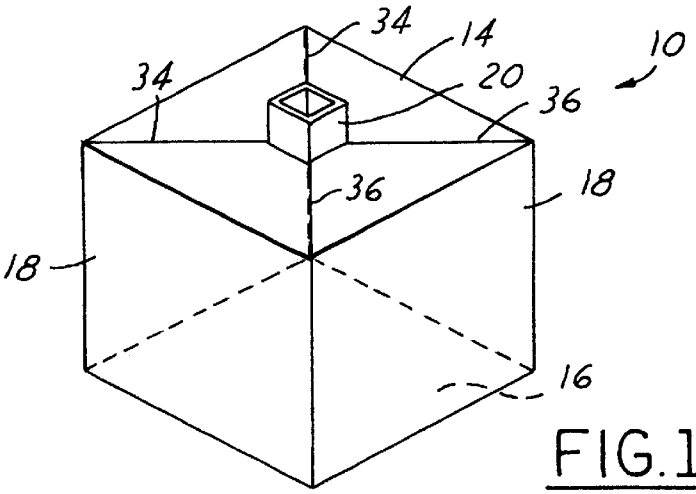
FIG. 1 is a perspective view of a bulk bag formed according to the method of the invention.
Figure 3:
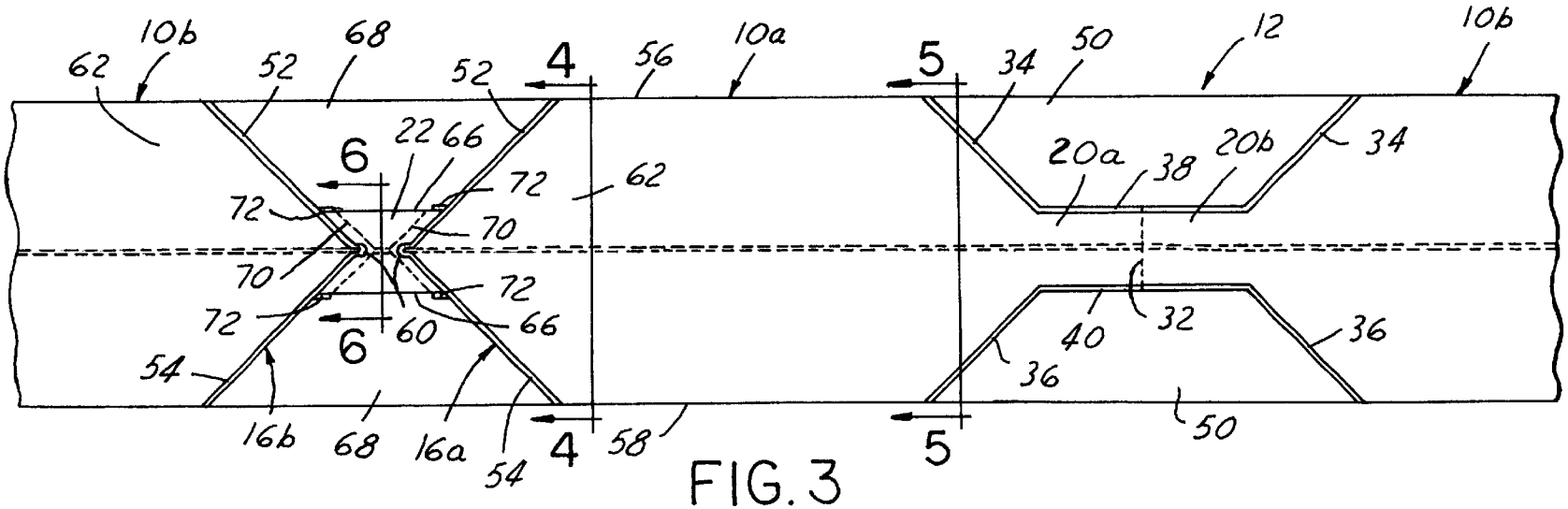
FIG. 3 is a plan view illustrating a plurality of interconnected bags formed from an elongate blank or roll of material with a V-shaped wall of one bag adjacent to a V-shaped wall of an adjacent bag.

Referring in more detail to the drawings, FIGS. 1–3 illustrate a collapsible bulk container or liner bag 10 according to the present invention which enables a plurality of such bags or liners 10*a*, 10*b* to be formed integrally along an elongate tubular web or blank 12 of a flexible material. The bulk bags 10 have a generally cubical configuration when expanded with generally rectilinear top 14, bottom 16 and sidewalls 18 with an integral spout 20 extending from the top wall 14 and providing an opening into the interior of the bag 10 to facilitate filling and emptying the bag. When a plurality of bags 10 are integrally formed with the bottom walls 16 of adjacent bags next to each other, an interconnecting section 22 of material permits the elongate blank 12 to be pulled or moved through downstream workstations and machinery without breaking or separating the elongate blank 12 between adjacent bags 10.

Figure 4:
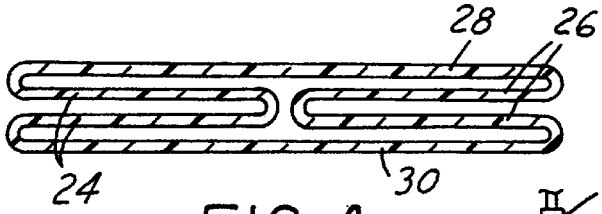
FIG. 4 is a sectional view taken generally along line 4—4 of FIG. 3.

The elongate blank 12 of material is preferably formed of a plastic film such as polyethylene or polypropylene plastic films generally having a thickness in the range of 4 to 10 mils, although other materials may suitably be used. Woven materials may also be used and a bulk bag or liner 10 formed from a plastic film material may be used in combination with a bag formed from a woven material if a high strength and leak proof container is desired. As best shown in FIG. 4, the elongate tubular blank 12 is preferably folded or otherwise manipulated to provide a pair of gusseted panels 24, 26 extending inwardly and disposed between a pair of overlying flat panels 28, 30. The elongate tubular blank 12 may be formed from a flat sheet with opposite side edges connected together to form a tube, may be initially provided as a circumferentially continuous tube, or may be formed from multiple blanks of material connected together to provide the desired gusseted arrangement.

To form a plurality of bags 10 along the gusseted blank 12, a plurality of heat seals are provided with perforations provided between adjacent bags 10*a*, 10*b* to facilitate removing a bag 10 from the blank 12. As shown in FIG. 3, desirably, the spouts 20*a*, 20*b* of adjacent bags 10*a*, 10*b* are connected together with a perforated line 32 separating the spout 20*a* of one bag 10*a* from the spout 20*b* of the other bag 10*b*. Inclined or diagonal heat seals 34, 36 define the upper wall 14 of each bag 10*a*, 10*b* and lead to parallel heat seals 38, 40 defining the spout 20 of each bag 10.

Figure 5:
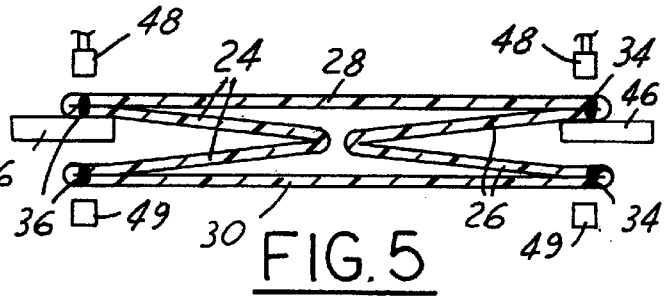
FIG. 5 is a sectional view taken generally along line 5—5 of FIG. 3.
Figure 6:
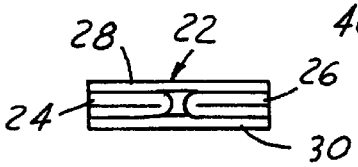
FIG. 6 is a sectional view taken generally along line 6—6 of FIG. 3.

The parallel heat seals 38, 40 preferably continue from one bag 10*a* to the adjacent bag 10*b* to form it's spout 20*b* and lead to the inclined heat seals 34,36 defining the top wall 14 of that bag 10*b*. As best shown in FIG. 5, each overlying flat panel 28, 30 is only heat sealed to the adjacent portion of only its adjacent gusseted panels 24, 26 without the overlapped portions of the gusseted panels 24, 26 being heat sealed together. To accomplish this, a material of low thermal conductivity, such as a rubber or teflon pad 46, is inserted between the gusseted panels 24, 26 during the heat sealing operation. Desirably, a pair of heat sealers 48, 49 are used with one on each side of the blank 12 to more evenly form the heat seals 34, 36, 38, 40 with the rubber or teflon pad 46 between them. So formed, the heat seals 34, 36, 38, 40 also define waste portions 50, which may be peeled away from the blank 12 and discarded. Desirably, when the heat sealers 48, 49 are engaged with the blank 12 and after the material of the blank 12 is sufficiently heated to form the heat seals, and while still warm the waste material 50 may be readily peeled away from the tubular blank along and outboard of the heat seals. With the spouts 20 of adjacent bags 10 still connected the elongate blank 12 may be advanced by automated machinery to subsequent workstations, such as to form the perforated line 32 facilitating separation of the spouts 20 of adjacent bags 10.

As shown in FIGS. 2,3, 7 and 8, to form the bottom wall 16 of each bag 10 on the elongate blank 12, each flat panel 28, 30 is connected to adjacent portions of the gusset panels 24, 26 along inclined or diagonal lines 52, 54. The inclined lines 52, 54 extend from side edges 56, 58 of the blank 12 to an apex 60 and define triangular portions 62 and a so-called V-bottom bulk bag. Desirably, the inclined heat seal lines 52, 54 intersect at a semi-circular juncture defining the apex 60 rather than at a point to provide a small amount of excess material in the bottom wall 16 of the bag 10 to reduce stress or strain at the juncture of the heat seals 52, 54 in the bottom of the wall of the bag when filled. Notably, at the apex 60 or juncture of the heat seals 52, 54, a plurality of layers of material are heat sealed together and therefore it is difficult to provide a sufficient heat seal without overheating or over melting of the bag material or under heating such that the heat seal is weak and may rupture in use. Accordingly, the extra material is desirable to reduce strain on the heat seals in this area. As with the top wall 14 of the bag 10, each of the overlying flat panels 28, 30 is heat sealed only to an adjacent portion of its adjacent gusseted panel 24 and 26 without heat sealing the overlapped portions of the gusseted panels 24,26 to themselves. When heat-sealed in this manner, the bottom wall 16 will be closed and substantially flat when the bag 10 is expanded.

Figure 7:
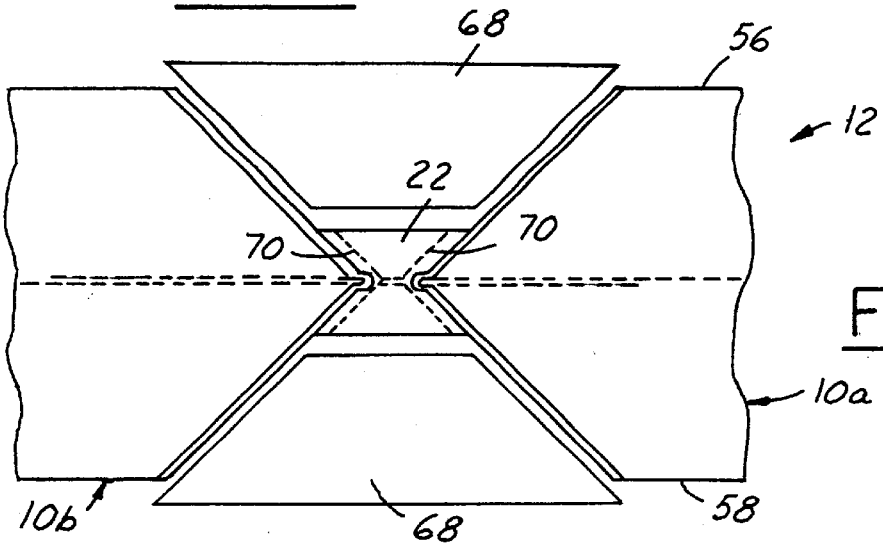
FIG. 7 is an enlarged fragmentary plan view illustrating the adjacent ends of a pair of adjacent bags on the roll of material.
Figure 8:
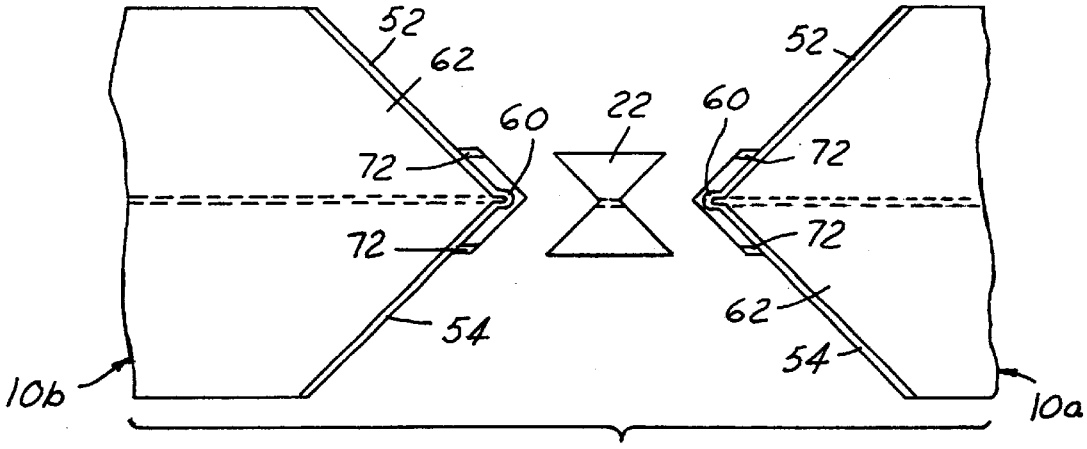
FIG. 8 is a fragmentary plan view illustrating adjacent ends of the bags separated from the roll of material.

According to an embodiment of the present invention, as shown in FIGS. 3, 7 and 8, bottom walls 16*a*, 16*b* of adjacent bags 10*a*, 10*b* are disposed adjacent to each other on the elongate blank. In conventional bags and methods of forming them, after the heat seals 52, 54 defining the bottom walls of adjacent bags are formed, all the material between the bags 10*a*, 10*b* would zipper, tear or peel away from the bags along the heat seals 52, 54 separating the bags from the blank 12 and separating the blank 12 between the ends of the bags 10*a*, 10*b*. To prevent all of the waste or scrap material from being removed from the blank 12 between the bottom walls 16 of adjacent bags 10, such that the elongate blank 12 would be separated between the bottom walls 16 of adjacent bags 10, a slit or tear line 66 is provided extending from each heat seal line 52, 54 (in both flat panels 28, 30) of one bag 10*a* to a corresponding heat seal 52, 54 in the adjacent bag 10*b*. When formed, a pair of substantially parallel, spaced apart tear lines 66 are formed in each flat panel 28,30 between adjacent bags 10*a*, 10*b* with an interconnecting section 22 of the blank between them and waste material 68 outboard of the tear lines 66. As shown, the tear lines 66 may be parallel and disposed on opposite sides of the apex 60 of each bag. Preferably the tear lines 66 are arranged in the direction of movement of the blank 12 to prevent the tear lines 66 from snagging or catching on components of the manufacturing equipment.

The interconnecting section 22 maintains the connection between adjacent bottom walls 16 of adjacent bags 10 to permit the elongate blank 12 to be pulled through further processing machines. Preferably, separation lines 70 which facilitate separation of individual bags 10 from the blank 12 are formed in the interconnecting section 22 and define two generally "V"-shaped lines. These "V" shaped lines follow the contours of the heat seal lines 52, 54 defining the bottom walls 16 of the bags 10, to reduce the extraneous material attached to the bottom wall 16 of each bag 10 when a bag is separated from the blank 12 for use. The tear lines 66 are preferably completely cut through the blank 12 or are a severely weakened or perforated portion of the blank 12 which tears more readily than the perforations from the blank 70 in the interconnecting section 22 to prevent separation of the interconnecting section 22 when the waste material 68 is removed. If both the tear lines 66 and separation lines 70 are formed by aligned perforations, the distance between adjacent perforations in a separation line 70 is preferably greater than the distance between adjacent perforations in a tear line 66 so that the tear lines 66 rip or tear more easily than the separation lines 70. The separation lines 70 and/or the tear lines 66 may provide reference points which facilitate locating the blank and bags thereon with various workstations. A laser or other visual indicator may be used as a reference with which the separation line 70, tear lines 66 or other feature of the bags may be aligned.

Preferably, to facilitate removing the waste material 68, a short tear diverter line 72 forms part of each tear line 66 and extends between each tear line 66 and a corresponding heat seal line 52 or 54 of each bag 10. Each tear diverter line 72 preferably comprises a short heat seal preferably formed at the same time as the heat seals 52, 54 by a tang or extension of the heat sealers 48, 49. Any rip or tear along the heat seals 52, 54 to remove the waste material 68 follows the tear diverter lines 72 to the remainder of the tear lines 66 which comprise either a complete cut through the blank 12 or aligned perforations, as previously discussed. Removal of the waste material 68 may occur while the heat sealers 48, 49 are engaged with the blank 12 such that the tang on the heat sealers helps to direct the tear along the tear diverter lines 72 to the tear lines 66 to leave the interconnecting section 22 in tact.

When constructed, to remove the waste material 68 it is separated from the edges 56, 58 of the blank 12 along the inclined heat seal lines 52, 54 defining the bottom wall 16 to the tear lines 66. The tear diverter lines 72 and the tangs which form them direct the tear or removal of the waste material to the tear lines 66. The tearing away of the waste material 68 continues along the tear lines 66 to the tear diverter lines 72 of the bottom wall 16 of the adjacent bag 10 and along the heat seal lines 52, 54 of the bottom wall of the adjacent bag 10 to the edges 56, 58 of the blank 12 completing removal of the waste material 68. Because the tear lines 66, preferably including the tear diverter lines 72, prevent removal of the interconnecting section 22 during processing of the elongate blank 12 to form a plurality of interconnected bulk bags 10, the blank 12 may be pulled or moved through subsequent processing machines and may be wound on a roll or accordion folded into a box as convenient for shipping and subsequent detachment and use of individual bags 10. As shown in FIGS. 7 and 8, when it is desired to separate a bag 10 from the elongate blank 12 it may be removed by tearing along the separation line 70 adjacent to that bag 10. At the same time or prior to use of the next bag 10 on the blank 12, the interconnecting section 22, which is generally shaped like a bow tie, may be removed along the other separation line 70 and discarded.

Accordingly, a plurality of bulk bags or liners 10 may be formed on an elongate blank 12 with an interconnecting section 22 connecting adjacent "V-shaped" end walls of the bags 10 to permit the blank 12 to be pulled or moved through subsequent processing without breaking or separating the blank 12 between adjacent bags 10. Still further, tear lines 66, which define in part waste material 68 between adjacent end or bottom walls 16 of adjacent bags 10 permit the waste material 68 to be removed without disconnecting a bag 10 from the elongate blank 12.

Second Embodiment

Figure 9:
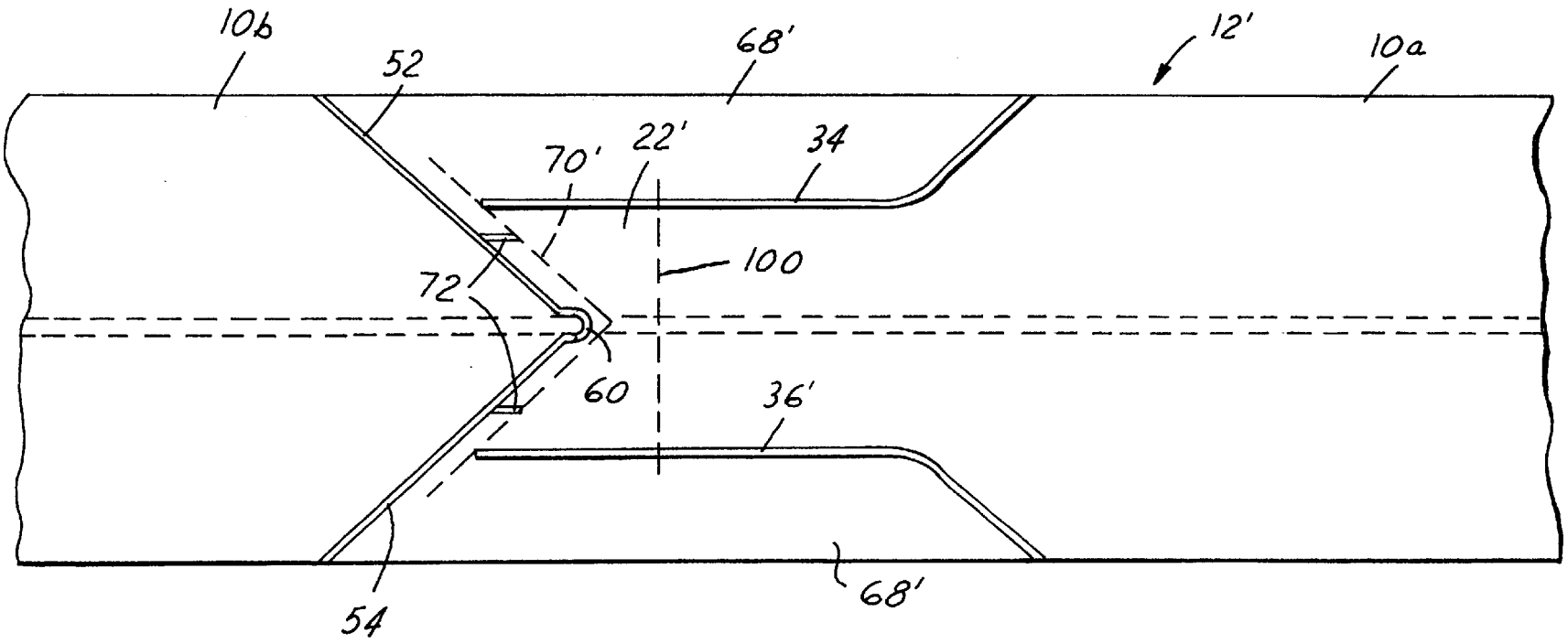
FIG. 9 is a plan view illustrating adjacent bags on a blank according to an alternate embodiment of the invention and having a V-shaped end wall of one bag adjacent to the spout of the other bag.

As shown in FIG. 9, a blank 12' may have bags 10*a*, 10*b* arranged with a spout 20*a* of one bag 10*a* adjacent to a V-shaped end wall of the other bag 10*b*. The individual bags 10*a*, 10*b* may be of the same construction as described with reference to the other embodiment and blank 12. To facilitate description of this embodiment, to the extent the bags are the same as in the previous embodiment, the same reference numbers will be applied. In this embodiment, a perforated line 100 defines the proper length of the spout 20*a*, and defines in part an interconnecting section 22' between the bags 10*a*, 10*b*. The spout 20*a* is shown as part of an end wall of the bag 10*a*. A V-shaped separation line 70' facilitates separation of a bag from the blank 12', and also defines in part the interconnecting section 22'. The remainder of the interconnecting section 22' is defined by heat seals 34' and 36' which define the spout 20*a* and which intersect, lead to or connect with the separation line 70'. Scrap material 68' is defined around the spout 20*a* and the V-shaped end wall by heat seals 34' and 36', and separation line 70' which leads to the tear diverter lines 72 which in turn lead to the heat seals 52 and 54 defining the V-shaped end wall. The separation line 70' may extend beyond the seals 34' and 36'. This permits widening or narrowing of the spout 20*a* as desired for a particular application without varying the separation line 70'.

Accordingly, when the scrap material 68' is separated or torn from the blank 12', the tear follows heat seals 34' and 36' until the tear reaches the separation line 70'. The tear follows the separation line 70' to the tear diverter lines 72 and then to heat seals 52 and 54 permitting complete removal of the waste material 68'. As in the previous embodiment, the interconnecting section 22' remains between and interconnecting the adjacent bags 10*a*,10*b* after removal of the waste material 68' to enable the blank to remain intact for further processing and the like.

Those skilled in the art will appreciate that modifications may be made without departing from the spirit and scope of the present invention as defined by the appended claims. For example, while the bulk bags or liners 10 have been described as having a spout 20 in the top wall 14, the bags 10 can be reversed with the spout in the bottom wall 16 and a closed top wall 14. Further, instead of a spout 20 at the top wall 14, the bags 10 may be generally open at their upper end, among other configurations, including a closed top and closed bottom with a spout or discharge opening in a sidewall 18 of the bag 10. Still other modifications and embodiments will be apparent from the teachings of this disclosure. As used in this description and the claims, the term flexible containers encompass and include both bags and liners.

What is claimed is:

1. A method of forming a plurality of interconnected flexible containers from an elongated blank of material, the method comprising the steps of:

providing the blank in gusseted form with a pair of gusset panels disposed between a pair of overlying flat panels;

forming a wall of a first container by connecting each flat panel to an adjacent portion of each gusset panel along at least one inclined line forming interconnected triangular portions;

forming a wall of a second container spaced from the wall of the first container by connecting each flat panel to the adjacent portion of each gusset panel along at least one inclined line forming interconnected triangular portions;

providing two separation and tear lines extending between and connecting corresponding inclined lines of the walls of the first container and second container and defining an interconnecting section of the blank between said two separation and tear lines and between the walls of the first and second containers, whereby scrap waste material between said two separation and tear lines may be removed from the blank without removing the interconnecting section of the blank to prevent complete separation of the blank between the walls of the first and second containers.

2. The method of claim 1 which also comprises the step of forming a separate tear diverter line extending along and forming a portion of each tear line with each tear diverter line extending to and intersecting a separate one of the inclined lines of one of the walls of the first and second containers.

3. The method of claim 2 wherein the inclined lines are formed by heat seals and the tear lines are defined by separate perforation lines in the blank.

4. The method of claim 2 wherein the tear diverter line is formed by heat sealing each flat panel to an adjacent portion of each gusset panel in like manner to the inclined lines of the walls of the first and second containers.

5. The method of claim 1 which also comprises the step of forming a separation line within the interconnecting section to facilitate separating a container from the blank with more force required to tear the blank along the separation line than is required to tear the blank along the tear lines so that a tear may be performed along the tear lines adjacent to a container without initiating or causing a tear along the separation line of that container.

6. The method of claim 5 wherein the separation line and tear line are each formed by aligned perforations in the blank with the distance between adjacent perforations in each separation line being greater than the distance between adjacent perforations in each tear line.

7. The method of claim 5 wherein the tear line is defined by a cut completely through a panel of the blank and the separation line is defined by aligned perforations in the blank.

8. The method of claim 1 wherein the step of forming the wall of both the first container and second container is accomplished by forming two inclined lines of connection leading to an apex to define the triangular portions of the walls of the first and second container and wherein the step of forming at least one tear line is accomplished by forming two tear lines spaced apart from each other with one tear line on each side of the apex to define the interconnecting section between the two tear lines and between the walls of the first and second containers.

9. A plurality of interconnected flexible containers formed on an elongated blank of material having opposed gusset panels received between overlying flat panels, the plurality of interconnected flexible containers comprising:

at least one end wall of each container on the blank defined by interconnected triangular portions defined by lines of connection between the flat panels and adjacent portions of the gusset panels, and at least two sidewalls of each container connected to a corresponding end wall and defined in part by one or more of the flat panels and gusset panels;

an interconnecting section between two separation lines extending across said blank, said interconnecting section connecting adjacent end walls of adjacent containers said separation lines facilitating a separation of a container from the interconnecting section, whereby waste material between adjacent bags may be removed from the blank without removing the interconnecting section of the blank to prevent complete separation of the blank between the end walls of adjacent containers.

10. The interconnected containers of claim 9 in which a tear line defines part of each separation line and facilitating a separation of the waste material without separating the interconnecting section from the blank.

11. The interconnected containers of claim 10 which also comprises a tear diverter line extending along and forming a portion of each tear line with a separate tear diverter line extending to and intersecting a separate one of the lines of connection of the end walls of containers.

12. The interconnected containers of claim 11 wherein each line of connection and each tear diverter line is defined by a heat seal.

13. The interconnected containers of claim 10 wherein the tear line and separation line are each defined by aligned perforations in the blank with the distance between perforations of the separation line being greater than the distance between perforations on the tear line so that waste material may be torn away from the blank along the tear line without tearing the blank along the separation line.

14. The interconnected containers of claim 10 wherein the tear line is defined by a cut completely through a panel of the blank and the separation line is defined by aligned perforations in the blank.

15. The interconnected containers of claim 10 which also comprises a second separation line within the interconnecting section and at least substantially separate from the other separation line to facilitate removal of the interconnection section from the blank after at least one of the containers connected to the interconnecting portion is removed from the blank.

16. The interconnected containers of claim 9 which also comprises a tear diverter line extending between a line of connection and a separation line, and said tear diverter line, line of connection, and separation line defining the waste material to facilitate removal of the waste material.

17. A method of forming a plurality of interconnected flexible containers from an elongated blank of material, the method comprising the steps of:

providing the blank in gusseted form with a pair of gusset panels disposed between a pair of overlying flat panels;

forming a wall of a first container by connecting each flat panel to an adjacent portion of each gusset panel along at least one inclined line forming interconnected triangular portions;

forming a wall of a second container spaced from and generally adjacent to the wall of the first container by connecting each flat panel to the adjacent portion of each gusset panel along appropriate lines;

providing an interconnecting section between two separation lines extending across the blank and between the walls of the first and second containers, whereby waste scrap may be removed from the blank without removing the interconnecting section of the blank to prevent complete separation of the blank between the walls of the first and second containers.

18. The method of claim 17 which also comprises the step of forming a separation line which defines in part the interconnecting section and facilitates separation of a bag from the blank.

19. The method of claim 17 which also comprises the step of forming a spout defining in part the wall of the second container by connecting the flat panels to their adjacent portions of each gusset panel along lines defining the spout.

20. The method of claim 19 wherein said lines defining the spout define in part the interconnecting section.

21. The method of claim 17 wherein the step of providing the two separation lines with the interconnecting section between them comprises, at least in part, forming two perforated lines along which each of the containers may be separated from the interconnecting section.

22. The method of claim 17 wherein the step of forming the wall of the second container is accomplished by connecting each flat panel to the adjacent portion of each gusset panel along at least one inclined line forming interconnected triangular portions.

23. The method of claim 21 which also comprises the step of forming a spout defining in part the wall of the second container by connecting each flat panel to adjacent portions of each gusset panel along lines defining the spout and wherein at least one of said perforated lines defines in part the spout.

24. The method of claim 18 which also comprises the step of forming a tear diverter line extending between the inclined line of the wall of the first container and the separation line.

* * * * *